US008720528B2

(12) United States Patent
Stephan et al.

(10) Patent No.: US 8,720,528 B2
(45) **Date of Patent: *May 13, 2014**

(54) METHOD AND DEVICE FOR CASTING A PISTON FOR AN INTERNAL COMBUSTION ENGINE

(75) Inventors: Silvio Stephan, Nuremberg (DE); Isabella Sobota, Nuremberg (DE); Rolf Pfeifer, Friedrichshafen (DE)

(73) Assignee: Federal-Mogul Nurnberg GmbH, Nurnberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/637,436

(22) PCT Filed: Mar. 24, 2011

(86) PCT No.: PCT/EP2011/054530

§ 371 (c)(1),
(2), (4) Date: Jan. 7, 2013

(87) PCT Pub. No.: WO2011/117342

PCT Pub. Date: Sep. 29, 2011

(65) Prior Publication Data

US 2013/0092341 A1 Apr. 18, 2013

(30) Foreign Application Priority Data

Mar. 26, 2010 (DE) ..... 10 2010 003 346

(51) Int. Cl.
*B22D 25/02* (2006.01)
*B22D 27/04* (2006.01)

(52) U.S. Cl.
USPC ..... 164/125; 164/348

(58) Field of Classification Search
USPC ..... 164/125, 348
See application file for complete search history.

(56) References Cited

U.S. PATENT DOCUMENTS

| | | | | |
|---|---|---|---|---|
| 4,164,920 | A * | 8/1979 | Brinkman | 123/499 |
| 4,450,610 | A * | 5/1984 | Schaper | 29/888.046 |
| 4,804,033 | A * | 2/1989 | Hepworth et al. | 164/97 |
| 2001/0030035 | A1 * | 10/2001 | Oda | 164/100 |
| 2007/0277952 | A1 | 12/2007 | Le Vert | |
| 2008/0128946 | A1 | 6/2008 | Boye | |

FOREIGN PATENT DOCUMENTS

| | | | |
|---|---|---|---|
| DE | 532267 | | 8/1931 |
| DE | 10234539 | | 2/2005 |
| DE | 10359066 | A1 | 7/2005 |
| DE | 102005027540 | A1 | 12/2006 |
| DE | 102006040046 | A1 | 2/2008 |
| DE | 102007012846 | B3 | 5/2008 |
| DE | 102008048761 | A1 | 3/2010 |
| WO | 2006133914 | A1 | 12/2006 |
| WO | 2008128153 | A1 | 10/2008 |

* cited by examiner

*Primary Examiner* — Kevin P Kerns
(74) *Attorney, Agent, or Firm* — Robert L. Stearns; Dickinson Wright, PLLC

(57) ABSTRACT

In a method for casting a piston for an internal combustion engine, after solidification of the surface layer in the region of the piston-pin bores (12), at least one mandrel provided there is withdrawn and the region of at least one piston-pin bore (12) is cooled by coolant supplied through at least one mandrel. A device for casting pistons for internal combustion engines has at least one mandrel which can be withdrawn from the region of a piston-pin bore (12) and through which a coolant for cooling the region of the piston-pin bores (12) can be supplied.

7 Claims, 1 Drawing Sheet

METHOD AND DEVICE FOR CASTING A PISTON FOR AN INTERNAL COMBUSTION ENGINE

BACKGROUND OF THE INVENTION

1. Technical Field

The invention relates to a method and a device for casting a piston for an internal combustion engine.

2. Related Art

In pistons of internal combustion engines, the strength of the so-called piston-pin bores, in which the piston pin is accommodated for connection with a piston rod, is of particular importance. The required strength can be achieved in particular by rapid quenching of the casting. According to the current procedure, such quenching only takes place outside the mold, when the piston as a whole has solidified to such an extent that it can be removed from the so-called mold.

DE 10 2005 027 540 A1 relates to a process for the production of a piston for internal combustion engines, in which the casting mould is opened before the melt in the region of a feeder has solidified. The piston can subsequently be removed and cooled outside the casting mold.

SUMMARY OF THE INVENTION

The object underlying the invention is to provide a method and a device for casting pistons for internal combustion engines, with which the strength, in particular in the region of the piston-pin bores, can be improved.

Accordingly, after boundary layer solidification in the region of at least one piston-pin bore, at least one sleeve provided there is withdrawn and that region is cooled by cooling agent supplied through at least one sleeve (14). As a result, the region of the piston-pin bores, in particular the largely cylindrical inner face thereof, can be cooled and quenched more quickly than is possible with the current procedure, so that the strength in those regions is advantageously increased. To that end, it is necessary to wait for only a certain degree of boundary layer solidification, which allows a sleeve provided there to be withdrawn without jeopardizing the shape of the piston in that region. A sleeve is substantially a largely cylindrical or slightly conical casting core which, during casting, keeps free the space subsequently intended for the piston pin and around which the material that surrounds the subsequent piston-pin bore is accordingly molded. With regard to the expression piston-pin bore, it is to be emphasized that this does not necessarily have to be formed by boring as a procedure according to the process. Rather, it is conventionally two substantially cylindrical openings in which the two ends of a piston pin are accommodated, while the piston rod is located between them in the assembled state.

Accordingly, the material surrounding the piston-pin bores can be cooled and quenched by the procedure according to the invention more quickly than has been possible hitherto, so that more rapid and more directed solidification is possible, which results in increased strength. In other words, the rate of solidification of the piston material in particular in the region of the piston-pin bores is increased, which leads to quenching and increased strength. Furthermore, directed solidification can also be produced by means of the described procedure in other regions of the piston.

It is at present preferred to carry out cooling of the piston-pin bores by means of compressed air. Initial considerations have shown that the compressed-air lines required therefor can be provided for all sizes of piston, in particular diesel pistons.

It is particularly preferred at present to withdraw two sleeves simultaneously and to cool the region of the piston-pin bores by cooling agent supplied through two sleeves simultaneously.

It has further been found to be advantageous to configure a core provided between the piston-pin bores to be withdrawable. As a result, in particular after initial cooling of the region of the piston-pin bores, further cooling agent, in particular compressed air, can be supplied, preferably to a lesser extent, so that the region between the piston-pin bores can also be cooled. In other words, the material that is in contact with the core until the core is withdrawn is cooled in order to achieve increased strength there too.

Cooling to a lesser extent can be effected by supplying cooling agent, in particular compressed air, through precisely one sleeve.

In particular, it has been found to be advantageous to supply cooling agent first through two sleeves and then, when a core has been withdrawn, through only precisely one sleeve. The flow of cooling agent through the region between the piston-pin bores is particularly efficient as a result.

The object mentioned above is further achieved by the casting device having at least one sleeve which can be withdrawn from the region of a piston-pin bore and through which a cooling agent for cooling the region of the piston-pin bores can be supplied. The advantages mentioned above can be achieved by such a device. The preferred embodiments of the device according to the invention correspond to the method features described above.

BRIEF DESCRIPTION OF THE DRAWINGS

A preferred exemplary embodiment of the invention is discussed in greater detail below. In the drawings.

DETAILED DESCRIPTION OF A PREFERRED EMBODIMENT OF THE INVENTION

Figure 1:
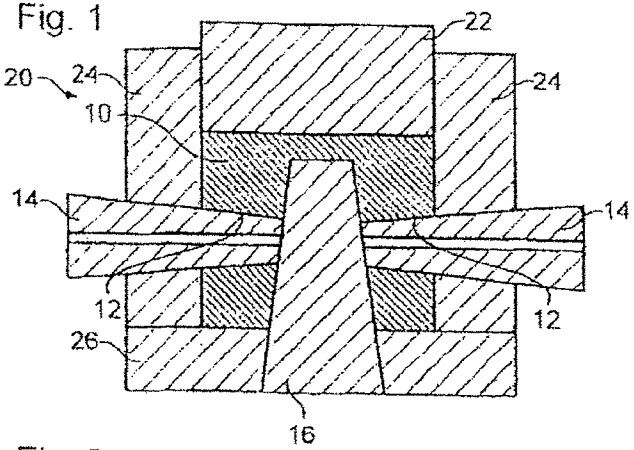
FIG. 1 shows a schematic side view of a casting device with a cast piston during a first solidification phase.

The casting device or mold 20 for a piston 10 shown schematically in section in FIG. 1 has various elements which initially define the outside shape of the piston. That is the case for the tool part 22 in the region of the piston head, the tool parts 24 in the region of the piston skirt, and a so-called fixing ring 26 in the region of the underside of the piston. In order to minimise mechanical reworking in the region of the piston-pin bores 12 as far as possible and to permit withdrawal, two sleeves 14 are provided in the embodiment shown, which sleeves 14 are slightly conical in shape. There is further present a core 16 for keeping free the region between the piston-pin bores 12 which is subsequently to receive the piston rod, which core 16 extends into the region above the pin bores 12 and is contacted by the sleeves. When the material for the piston 10 has been introduced in liquid form into the casting device 20 so configured, solidification of the material takes place, starting from the boundary layers.

Figure 2:
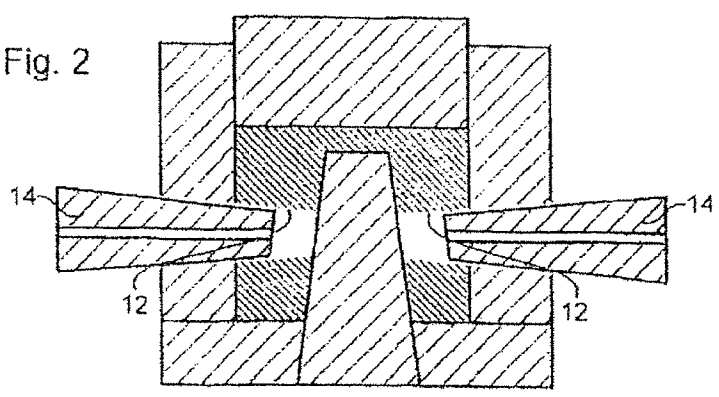
FIG. 2 shows a schematic side view after withdrawal of the sleeves.

As is shown in FIG. 2, after a first boundary layer solidification, which takes place in particular also in the piston-pin bores 12, at least one sleeve 14, in the exemplary embodiment shown both sleeves 14, is withdrawn in order to free the region of the piston-pin bores 12, in particular on the inside thereof. According to the invention, purposive cooling of those inner faces subsequently takes place.

Figure 3:
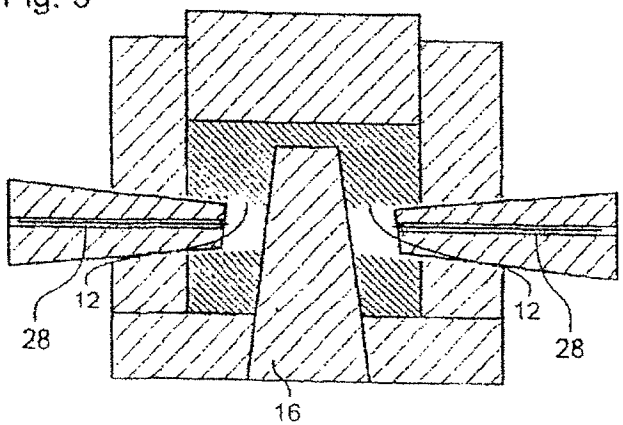
FIG. 3 shows a schematic side view during the supply of compressed air through the sleeves.

As is shown in FIG. 3, this is achieved in the exemplary embodiment shown by supplying compressed air through the sleeves 14. In particular, the sleeves 14 have in the case shown central feed channels 28. Compressed air flows through the described channels 28 to the inner faces of the piston-pin bores 12, so that they are cooled and quenched and subsequently have increased strength.

Figure 4:
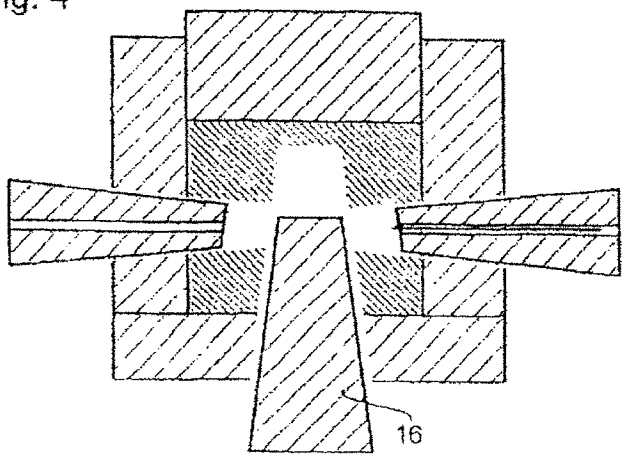
FIG. 4 shows a schematic side view after the tool core has been withdrawn.

In FIG. 4, the preferred procedure is shown, in which the core 16 is subsequently withdrawn in order to free also the inner faces in the region between the piston-pin bores, which hitherto were in contact with the core 16, and to effect cooling and quenching thereto, before the piston as a whole can be removed from the casting apparatus or mold. Cooling of the region between the piston-pin bores preferably takes place through only one sleeve 14.

| | |
|---|---|
| Boden | Head |
| Pinole | Sleeve |
| Mantel | Skirt |
| Kern | Core |
| Fixierung | Fixing |

The invention claimed is:

1. A method of casting a piston for an internal combustion engine having piston-pin bores, comprising:

establishing during casting boundary layer solidification in the region of the piston-pin bores, and about at least one sleeve provided in the region of at least one of the piston-pin bores;

supplying a cooling agent through the at least one sleeve and thereafter withdrawing the sleeve; and wherein there are two sleeves provided in the region of two piston-pin bores which are cooled by the cooling agent supplied through the sleeves simultaneously; and wherein the sleeves are subsequently withdrawn.

2. The method according to claim 1, wherein the cooling agent is compressed air.

3. The method according to claim 1, including providing at least one core in a region between the piston-pin bores which causes said region to cool during casting, after which the at least one core is withdrawn.

4. The method of claim 3, wherein the cooling imparted by the at least one core is lesser than the cooling imparted by the at least one sleeve.

5. A method of casting a piston for an internal combustion engine having piston-pin bores, comprising:

establishing during casting boundary layer solidification in the region of the piston-pin bores, and about at least one sleeve provided in the region of at least one of the piston-pin bores;

supplying a cooling agent through the at least one sleeve and thereafter withdrawing the sleeve; and wherein there are two sleeves and wherein a cooling agent is supplied first through both sleeves and then through precisely one sleeve.

6. The method according to claim 5, wherein the cooling agent is supplied first through both sleeves and then, when a core which is first inserted during casting in a region between the piston-pin bores to cool such region and then is withdrawn, supplying the cooling agent through precisely only one sleeve which causes the cooling agent to also flow through the region between the piston-pin bores from which the core was withdrawn.

7. The method of claim 5, wherein the cooling agent is compressed air.

* * * * *

UNITED STATES PATENT AND TRADEMARK OFFICE

CERTIFICATE OF CORRECTION

PATENT NO. : 8,720,528 B2
APPLICATION NO. : 13/637436
DATED : May 13, 2014
INVENTOR(S) : Stephan et al.

It is certified that error appears in the above-identified patent and that said Letters Patent is hereby corrected as shown below:

On the Title Page, Item (75) 1st and 2nd inventors on front of patent lines 1-2:
City should read "Nurnberg"

In the Specification
Column 2, line 53 "minimise" should read "minimize"

Signed and Sealed this
Fifth Day of August, 2014

Michelle K. Lee

Michelle K. Lee
*Deputy Director of the United States Patent and Trademark Office*